US007542708B2

(12) United States Patent
Kuwabara et al.

(10) Patent No.: US 7,542,708 B2
(45) Date of Patent: Jun. 2, 2009

(54) IMAGE FORMING APPARATUS

(75) Inventors: Akitomo Kuwabara, Ibaraki (JP); Takeshi Terakado, Ibaraki (JP); Hidenori Iwanaga, Ibaraki (JP); Yuuki Kikushima, Ibaraki (JP); Arinobu Yoshiura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 11/837,628

(22) Filed: Aug. 13, 2007

(65) Prior Publication Data

US 2008/0050157 A1 Feb. 28, 2008

(30) Foreign Application Priority Data

Aug. 24, 2006 (JP) ..... 2006-227892

(51) Int. Cl.
*G03G 15/16* (2006.01)

(52) U.S. Cl. ..... 399/316

(58) Field of Classification Search ..... 399/311, 399/316, 318, 351, 384, 388
See application file for complete search history.

(56) References Cited

U.S. PATENT DOCUMENTS 5,300,993 A * 4/1994 Vetromile ..... 399/339
5,300,994 A * 4/1994 Gross et al. ..... 399/339
5,539,508 A * 7/1996 Piotrowski et al. ..... 399/170
6,556,805 B1 * 4/2003 Kuo et al. ..... 399/316
6,687,480 B2 * 2/2004 Obrien et al. ..... 399/316

FOREIGN PATENT DOCUMENTS

JP 09-171308 6/1997

* cited by examiner

*Primary Examiner*—Jong-Suk (James) Lee
*Assistant Examiner*—David R Crowe

(57) ABSTRACT

An image forming apparatus having a transfer assist mechanism is disclosed. The transfer assist mechanism includes a first blade holder having a first blade, second blade holders having corresponding second blades, and a first slide engaging member and a second slide engaging member which engage the first and second blade holders. When the first slide engaging member and the second slide engaging member are moved corresponding to the width of a continuous recording medium, the first blade holder and some of the second blade holders are selected corresponding to the width of the continuous recording medium, and the first blade and some of the second blades corresponding to the selected some of the second blade holders press the continuous recording medium.

6 Claims, 9 Drawing Sheets

RECORDING MEDIUM MAY PASS THROUGH NON-RECORDING REGION
RECORDING MEDIUM MAY PASS THROUGH

IMAGE FORMING APPARATUS

BACKGROUND OF THE INVENTION

1. Field of the Invention

The present invention generally relates to an image forming apparatus which transfers a toner image formed on a surface of a photosensitive body onto a recording medium at high accuracy by pressing the recording medium on the surface of the photosensitive body.

2. Description of the Related Art

Conventionally, in many cases, a continuous paper printer has been used for printing outputs from a computer on a ledger sheet. Recently, by utilizing a function which prints variable information at a high speed, the continuous paper printer has been used for printing various documents such as direct mail, invoices, instruction manuals, and books. By widened application of the continuous paper printer, the continuous paper printer must use various kinds of the recording media, for example, thin paper, thick paper, high-quality paper, and rough surface paper.

In addition, from a viewpoint of resource savings, both sides printing has been widely used. When both sides printing is executed by a cut sheet printer, an image is printed on the first surface (front surface) of a sheet, and another image is printed on the second surface (back surface) of the sheet by reversing the sheet.

In addition, in some cases, both sides printing is executed by disposing two continuous paper printers in tandem. In this case, a first continuous paper printer prints an image on the first surface of a recording medium and a second continuous paper printer prints another image on the second surface of the recording medium by reversing the recording medium. In order to obtain a high-quality image, image transfer performance of transfer sections in the continuous paper printer must be high.

The printer (image forming apparatus) includes a fixing section for fixing a toner image transferred onto a recording medium. The fixing section is disposed at a downstream side of the transfer section, and includes a pre-heater for preheating the recording medium by contacting the recording medium, a heat roller having a heater, and a backup roller for applying pressure to the heat roller.

In the fixing section, the pre-heater and the heat roller continue to apply heat to the recording medium while executing continuous printing and stop applying the heat when the continuous printing stops. Soon after the continuous printing stops, since the carrying speed of the recording medium does not immediately respond to the heat amount being applied to the recording medium, the recording medium is over-heated.

Consequently, a part of the recording medium stopped on the pre-heater may be expanded or shrunk or may have a concave-convex surface formed by the heat. In both sides printing, when a part of the recording medium, which part is stopped on the pre-heater in the first printer or in the first printing of a printer, is passed through the second printer or the second printing of the printer, a part of the toner image on the surface of the photosensitive body may not be transferred onto the recording medium due to the rough surface of the recording medium caused by the heat. That is, a high-quality image may not be printed due to the toner image non-transferred part.

In addition, in both sides printing, in the second printer or the second printing in a printer, the contact of the recording medium with the photosensitive body may be reduced due to damage (expansion or shrinkage) on the recording medium caused by the heat in the first printer or the first printing in the printer.

In Japanese Laid-Open Patent Application No. 9-171308, a recording medium is pressed on a photosensitive body by using a transfer assist blade, and a toner image is transferred onto the surface of the recording medium by correcting the rough surface of the recording medium with the transfer assist blade. With this, image quality degradation on the surface of the recording medium caused by fatigue and/or deformation of the surface of the recording medium due to the heat application is reduced.

In addition, various kinds of recording media are used in the continuous paper printer, and the width of the recording medium may be changed corresponding to application. When a wide photosensitive body of width 21 to 22 inches (533.4 to 558.8 mm) is used, the recording media whose widths are 12, 16, and 22 inches can be used. For example, when the recording medium is a ledger sheet, the width of the ledger sheet is 12 or 16 inches. When an instruction manual or a book is printed, since the printed recording medium is cut after the printing, the width of the photosensitive body is 17inches (431.8 mm) from which two sheets of A4 size (210 mm×297 mm) recording medium are obtained. Further, when a photosensitive body of 22-inch (558.8 mm) width is used, three sheets of B5 size (182 mm×257 mm) recording medium can be obtained.

Therefore, in a case where an image is printed on a recording medium of short width, when a transfer assist blade whose width is greater than the width of the recording medium is used, a part of the transfer assist blade sticks out from the recording medium and the stuck out transfer assist blade may damage the photosensitive drum.

In order to solve the above problem, in Japanese Laid-Open Patent Application No. 9-171308, plural assist blades are used and the plural assists blades are combined corresponding to the width of the recording medium.

In Japanese Laid-Open Patent Application No. 9-171308, the combination of the plural transfer assist blades responds to a recording medium of an arbitrary width; however, each of the plural transfer assist blades is independently driven by plural solenoids. Therefore, when the plural transfer assist blades are disposed between the transfer section and the photosensitive body, the size of the image forming apparatus becomes large and the cost of the image forming apparatus becomes high.

SUMMARY OF THE INVENTION

In a preferred embodiment of the present invention, there is provided an image forming apparatus which can form high-quality images at low cost on recording media having various widths and having rough surfaces caused by heat without damaging the images.

Features and advantages of the present invention are set forth in the description that follows, and in part will become apparent from the description and the accompanying drawings, or may be learned by practice of the invention according to the teachings provided in the description. Features and advantages of the present invention will be realized and attained by an image forming apparatus particularly pointed out in the specification in such full, clear, concise, and exact terms so as to enable a person having ordinary skill in the art to practice the invention.

To achieve one or more of these and other advantages, according to one aspect of the present invention, there is provided an image forming apparatus. The image forming apparatus includes a photosensitive body on which surface an electrostatic latent image is formed, a developer which forms a toner image on the surface of the photosensitive body by developing the electrostatic latent image formed on the surface of the photosensitive body, a transfer unit which transfers the toner image formed on the surface of the photosensitive body onto a recording medium, recording medium carrying members which carry the recording medium to a nip region between the photosensitive body and the transfer unit, and a transfer assist mechanism which presses the recording medium on the surface of the photosensitive body by adjusting a width where the recording medium presses the surface of the photosensitive body corresponding to the width of the recording medium. The transfer assist mechanism includes a hinge shaft which is disposed in a transfer housing of the transfer unit in parallel to the width direction of the recording medium, a first blade holder having a first blade which is rotatably held by the hinge shaft by being formed in the width direction of the recording medium, plural second blade holders having corresponding second blades which are rotatably held by the hinge shaft by being formed with the first blade holder in the width direction of the recording medium, first engaging grooves which are formed in the first blade holder and the plural second blade holders, second engaging grooves which are formed in the first blade holder and the second blade holders, a slide engaging member which is movably formed in the width direction of the recording medium by engaging the first engaging grooves and the second engaging grooves of the first blade holder and some of the second blade holders selected corresponding to the width of the recording medium, a driving mechanism including a motor which drives the first blade holder and some of the second blade holders selected corresponding to the width of the recording medium in the pressing direction of the recording medium, and a pressing range adjusting mechanism for adjusting the number of the second blade holders which engage the second engaging grooves of the slide engaging member by moving the slide engaging member in the width direction of the recording medium corresponding to the width of the recording medium.

EFFECT OF THE INVENTION

According to an embodiment of the present invention, a slide engaging member is moved in the width direction of a recording medium corresponding to the width of the recording medium, and the number of second blade holders engaging second engaging grooves of a second engaging member of the slide engaging member is adjusted corresponding to the width of the recording medium. With this, a first blade holder having a first blade and the adjusted number of the second blade holders having corresponding second blades are rotated by a hinge shaft, and the first blade and the adjusted number of the second blades press the recording medium on the surface of the photosensitive body. That is, the first blade and the adjusted number of the second blades do not press the surface of the photosensitive body in a region where the recording medium does not extend. Therefore, the photosensitive body is not damaged by the first and second blades. In addition, since the position of the slide engaging member is adjusted by one motor and the second blades are selectively rotated corresponding to the width of the recording medium, a large space is not required and the cost can be low.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENT

[Best Mode of Carrying Out the Invention]

The best mode of carrying out the present invention is described with reference to the accompanying drawings.

First, a structure of an image forming apparatus is described. Then a transfer unit and a transfer assist mechanism are described which are main elements in the image forming apparatus.

[Structure of Image Forming Apparatus]

Figure 1:
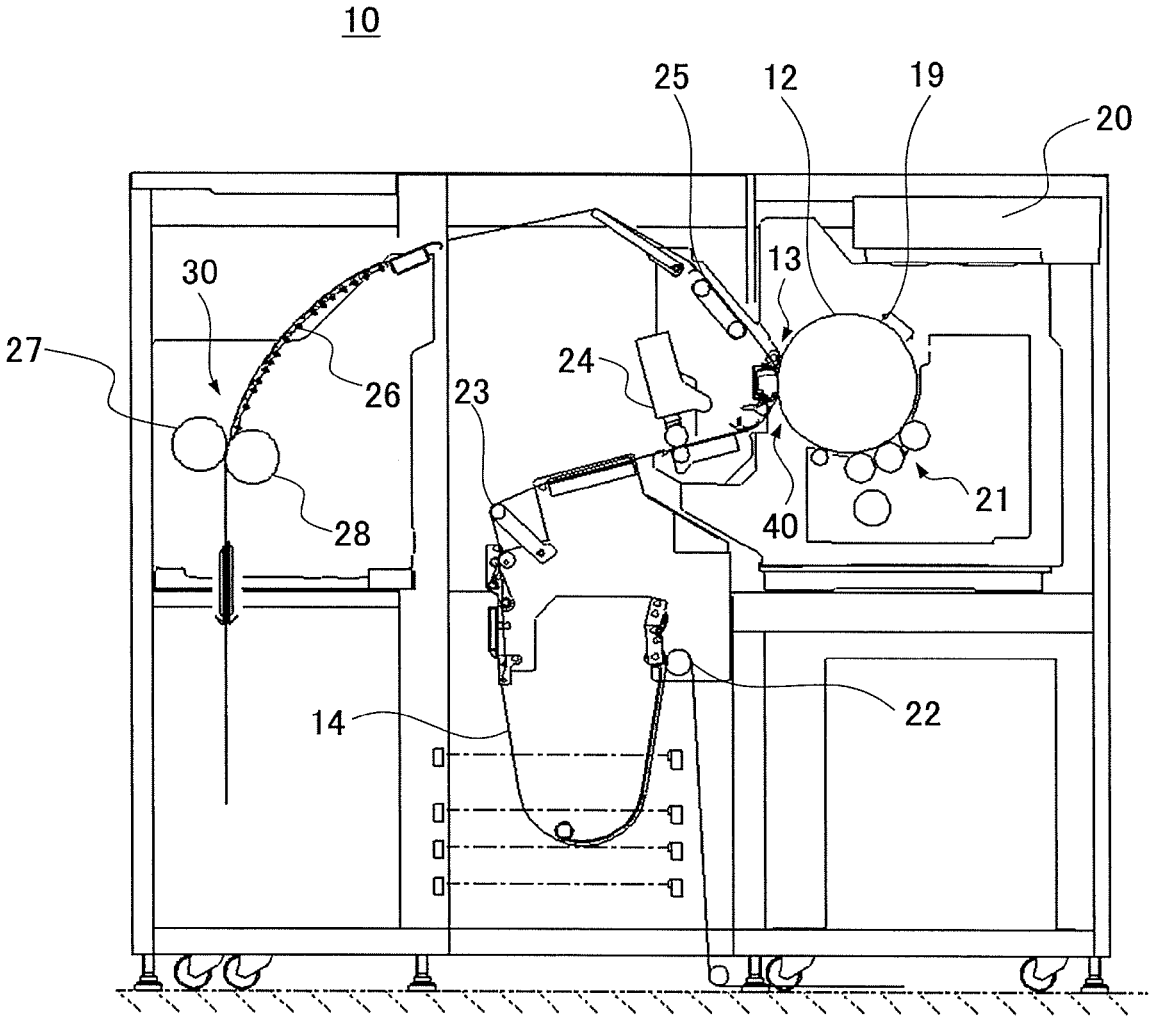
FIG. 1 is a schematic diagram showing a structure of an image forming apparatus according to an embodiment of the present invention.

FIG. 1 is a schematic diagram showing a structure of an image forming apparatus according to an embodiment of the present invention.

As shown in FIG. 1, in an image forming apparatus 10, a charger 19, an exposure unit 20, a developer 21, and a corona transfer device 13 are disposed along the rotational circumference surface of a photosensitive drum 12 (photosensitive body). Electric charges are uniformly applied onto the surface of the photosensitive drum 12, and laser beams are irradiated on the surface of the photosensitive drum 12 by the exposure unit 20 corresponding to image data. With this, an electrostatic latent image is formed on the surface of the photosensitive drum 12. Then a toner image is formed on the surface of the photosensitive drum 12 by developing the electrostatic latent image with the developer 21.

A continuous recording medium 14 (recording medium) is carried to a transfer unit 40 by recording medium carrying members (tractors) 22, 23, and 24 disposed at the upstream side of the transfer unit 40.

The continuous recording medium 14 is used in producing, for example, direct mail, invoices, instruction manuals, and books by printing necessary materials on the continuous recording medium 14. The continuous recording medium 14 may be formed of various kinds of sheets such as thin paper, thick paper, high-quality paper, or rough surface paper. In addition, the width of the continuous recording medium 14 is different among the printing purposes. When the width of the continuous recording medium 14 is desired to be changed, the widths of the recording medium carrying members 22, 23, and 24 are changed so that the width of the continuous recording medium 14 matches the widths of the recording medium carrying members 22, 23, and 24.

The transfer unit 40 transfers the toner image formed on the surface of the photosensitive drum 12 onto the continuous recording medium 14 by using the corona transfer device 13. The continuous recording medium 14 on which the toner image is formed is carried by a recording medium carrying member 25 to a fixing unit 30.

The toner image transferred onto the continuous recording medium 14 is heated approximately to the transition temperature of the toner resin when passing through a pre-heater 26. Then the continuous recording medium 14 reaches the fixing section 30 formed of a heat roller 27 having a heater and a backup roller 28. The toner image on the continuous recording medium 14 is fixed by heat from the heat roller 27 and pressure applied by the backup roller 28.

When both sides printing is executed, by using the image forming apparatus 10, a toner image is transferred onto the front surface (first surface) (not shown) of the continuous recording medium 14 at the first printing and the toner image is fixed, and another toner image is transferred onto the back surface (second surface) (not shown) of the continuous recording medium 14 at the second printing and the toner image is fixed.

Figure 2:
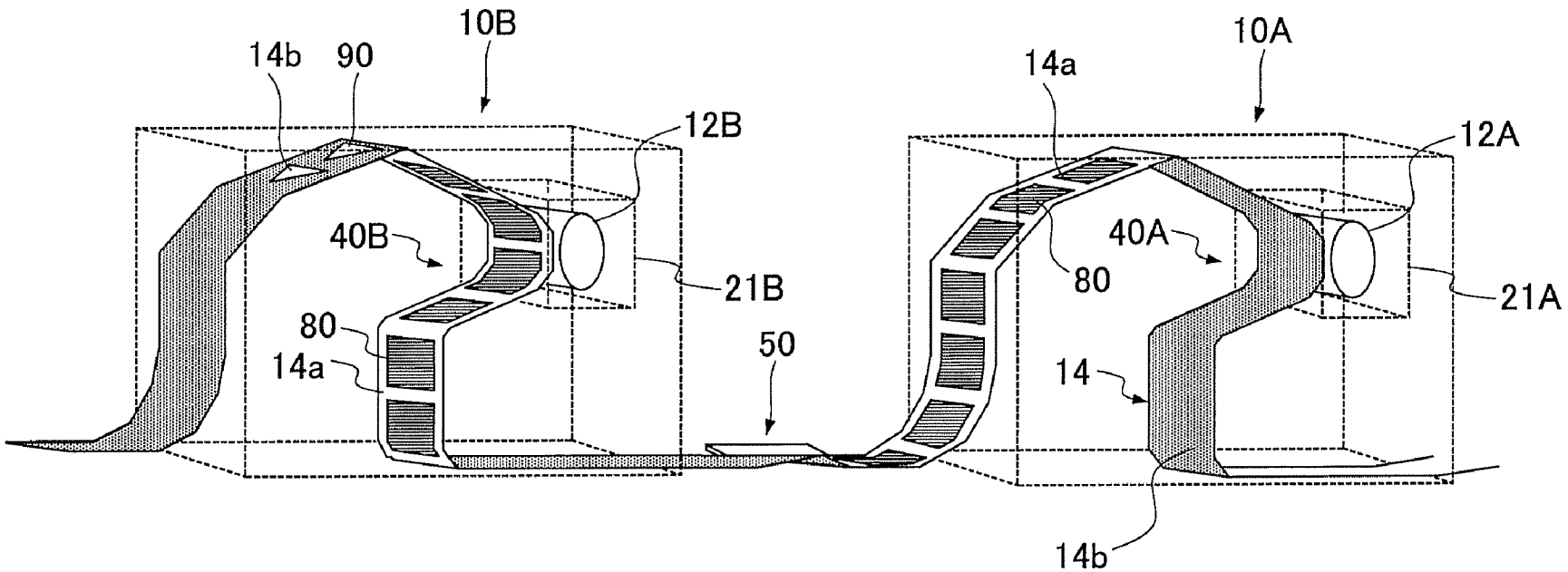
FIG. 2 is a schematic diagram showing a tandem type printing system for executing both sides printing according to the embodiment of the present invention.

FIG. 2 is a schematic diagram showing a tandem type printing system which can execute both sides printing according to the embodiment of the present invention. As shown in FIG. 2, when the tandem type printing system is used, first and second image forming apparatuses 10A and 10B are disposed, and a reversing mechanism 50 is disposed between the first and second image forming apparatuses 10A and 10B. The reversing mechanism 50 reverses the surface of the continuous recording medium 14 from a front surface 14*a* to a back surface 14*b* of the continuous recording medium 14. In FIG. 2, a first photosensitive drum 12A, a first developer 21A, and a first transfer unit 40A of the first image forming apparatus 10A are shown; and a second photosensitive drum 12B, a second developer 21B, and a second transfer unit 40B of the second image forming apparatus 10B are shown. In addition, in FIG. 2, a first image 80 (described below) and a second image 90 (described below) are shown.

[Structures of Transfer Unit and Transfer Assist Mechanism]

Figure 3:
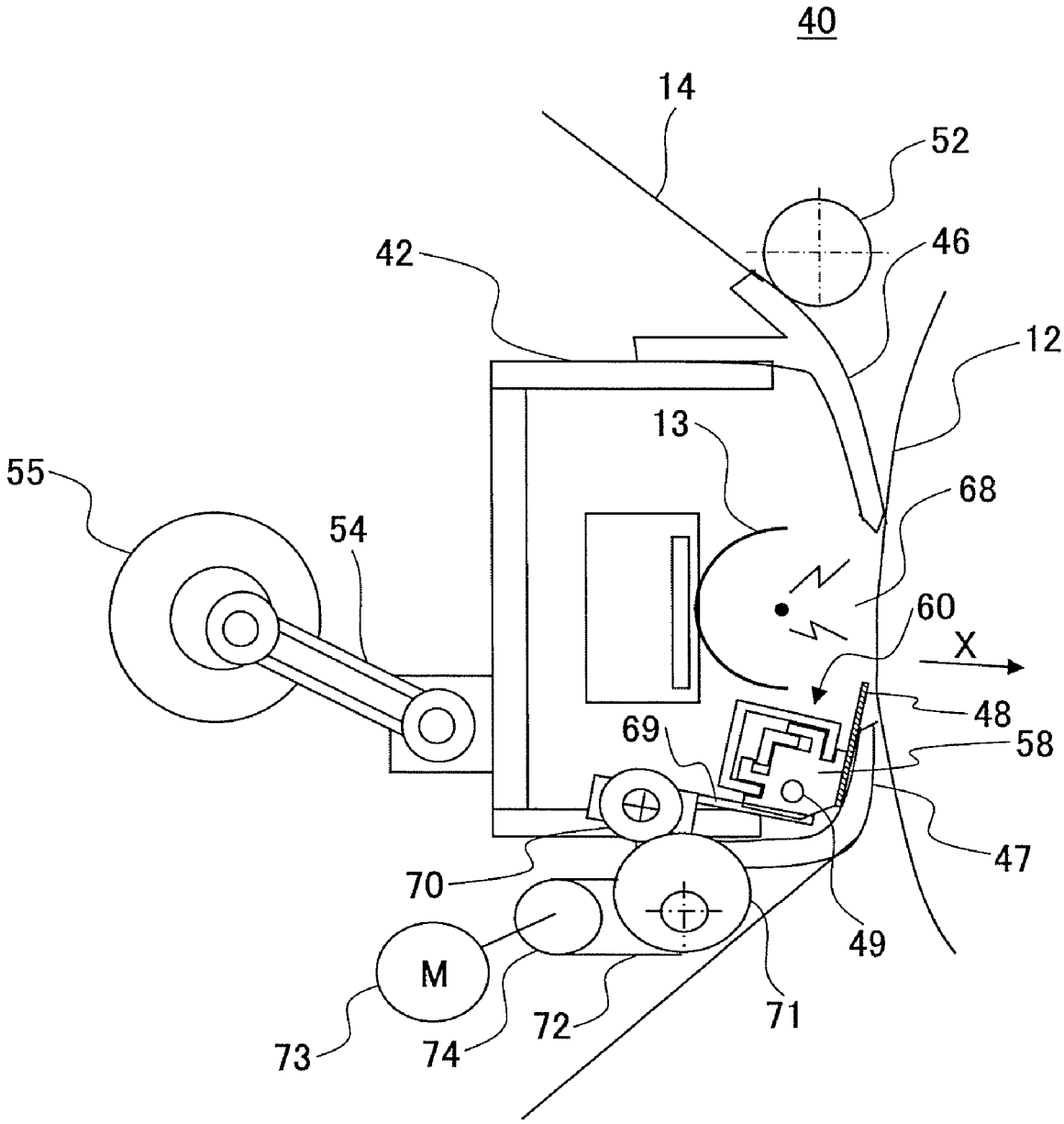
FIG. 3 is a schematic diagram showing a transfer unit shown in FIG. 1.

FIG. 3 is a schematic diagram showing the transfer unit 40 shown in FIG. 1. The photosensitive drum 12 is formed of a material which is positively charged, for example, a selenium material, a positive charge OPC (organic photosensitive) material, and an a-Si (amorphous-silicon) photosensitive material. The developing system on the photosensitive drum 12 is a reversal developing system and the charge polarity of the toner is positive.

As shown in FIG. 3, the transfer unit 40 includes a transfer housing 42. The corona transfer device 13 disposed in the transfer housing 42 negatively charges the continuous recording medium 14, and a transfer assist mechanism 60 is disposed under the corona transfer device 13. In FIG. 3, a nip region 68 (described below) is shown.

The transfer housing 42 is rotatably held by an axle 52 disposed above the transfer housing 42. When a rotational force of a driving motor 55 is transmitted to the transfer housing 42 via a link 54, the transfer housing 42 is rotated with the axle 52 as the center. In a print mode, the driving motor 55 drives the transfer housing 42 to approach the photosensitive drum 12, and makes the continuous recording medium 14, hung between an upper separator 46 and a lower separator 47, contact the outer circumference surface of the photosensitive drum 12. Elements having the corresponding reference numbers 48, 49, 58, 69, and 70 through 74 shown in FIG. 3 are described below.

Figure 4:
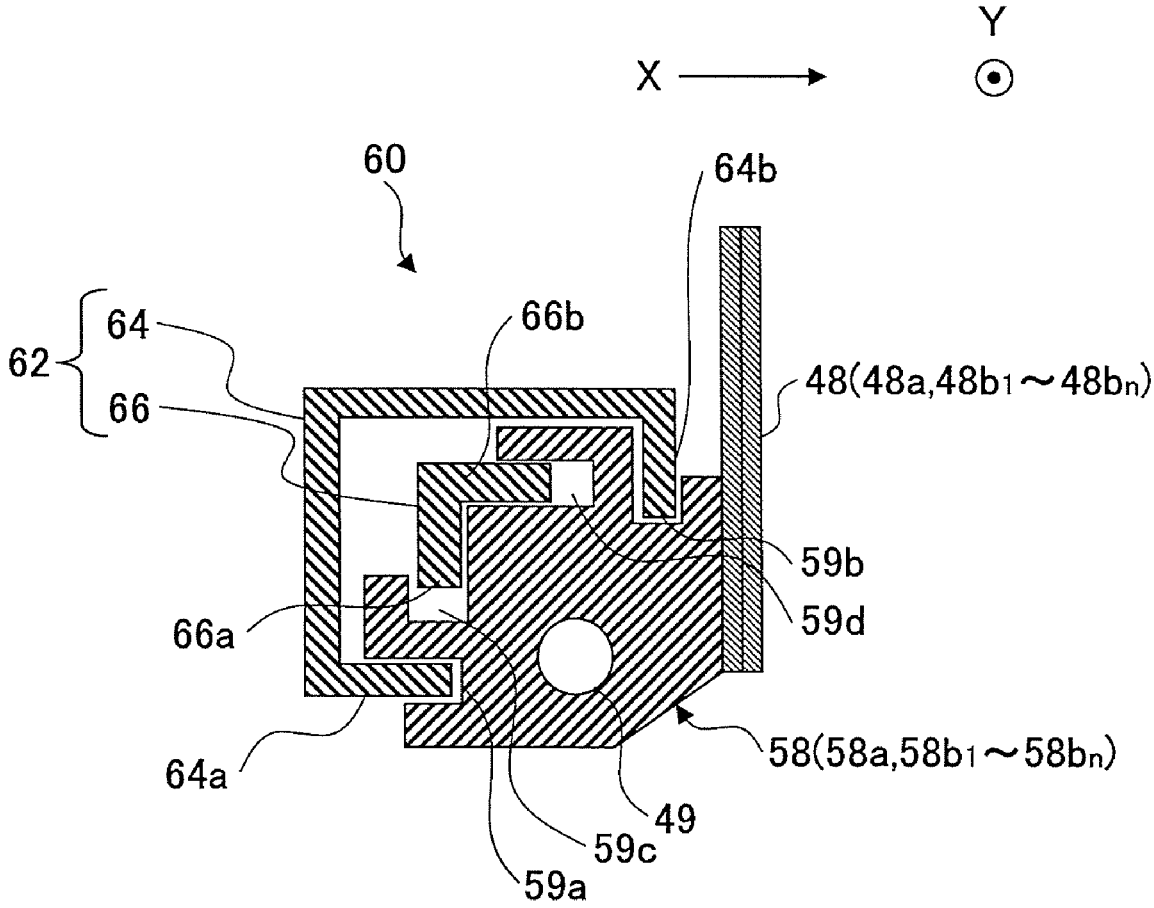
FIG. 4 is a cut-away side view of a transfer assist mechanism shown in FIG. 3.

FIG. 4 is a cut-away side view of the transfer assist mechanism 60 shown in FIG. 3. As shown in FIG. 4, the transfer assist mechanism 60 includes a transfer assist blade 48, a blade holder 58, and a slide engaging section 62 which engages the blade holder 58 and moves in the width direction of the continuous recording medium 14 (Y direction). In FIG. 4, a hinge shaft 49 (described below) is shown.

In the following, when a suffix is not attached to a reference number of an element, the reference number represents the set of elements. For example, the transfer assist blade 48 represents a first blade 48*a* and second blades 48$b_1$ through 48$b_n$.

In the transfer assist mechanism 60, at printing an image on the continuous recording medium 14, the blade holder 58 holding the transfer assist blade 48 is rotated clockwise about the hinge shaft 49 as the center, the tip of the transfer assist blade 48 presses the continuous recording medium 14 on the surface of the photosensitive drum 12, and the continuous recording medium 14 is held in close contact with the surface of the photosensitive drum 12. With this, for example, even if a part of the continuous recording medium 14 is a rough surface having a concave-convex surface, or is deformed due to heat at the fixing process, a toner image formed on the surface of the photosensitive drum 12 can be transferred onto the continuous recording medium 14 at high accuracy.

The blade holder 58 includes a first blade holder 58*a* and second blade holders 58$b_1$ through 58$b_n$. The cross-sectional shapes of the first blade holder 58*a* and the second blade holders 58$b_1$ through 58$b_n$ viewed from the Y direction are equal. However, the width of the first blade holder 58*a* is different from the width of the second blade holders 58$b_n$ through 58$b_n$ in the Y direction. The slide engaging section 62 includes a first slide engaging member 64 and a second slide engaging member 66. Engaging parts 64*a* and 64*b* of the first slide engaging member 64 engage corresponding first engaging grooves 59*a* and 59*b* of the blade holder 58. The first engaging groove 59*a* is formed at the back of the blade holder 58 and the first engaging groove 59*b* is formed at the top of the blade holder 58. The cross-sectional shape of the first slide engaging member 64 is first formed as an approximately "L" shape when viewed from the Y direction and the engaging parts 64*a* and 64*b* are formed by being bent in the corresponding orthogonal directions from the corresponding ends of the "L"-shaped first slide engaging member 64. Since the engaging parts 64*a* and 64*b* are engaged with and inserted into the corresponding first engaging grooves 59*a* and 59*b*, the first slide engaging member 64 can be slid in the Y direction without being dropped.

In addition, engaging parts 66*a* and 66*b* of the second slide engaging member 66 engage and are inserted into corresponding second engaging grooves 59*c* and 59*d* of the blade holder 58. The second engaging groove 59*c* is formed at the back of the blade holder 58 and the second engaging groove 59*d* is formed at the top of the blade holder 58. The cross-sectional shape of the second slide engaging member 66 is an approximately "L" shape when viewed from the Y direction. Since the engaging parts 66*a* and 66*b* are inserted into the corresponding second engaging grooves 59*c* and 59*d*, the second slide engaging member 66 can be slid in the Y direction without being dropped.

Figure 5:
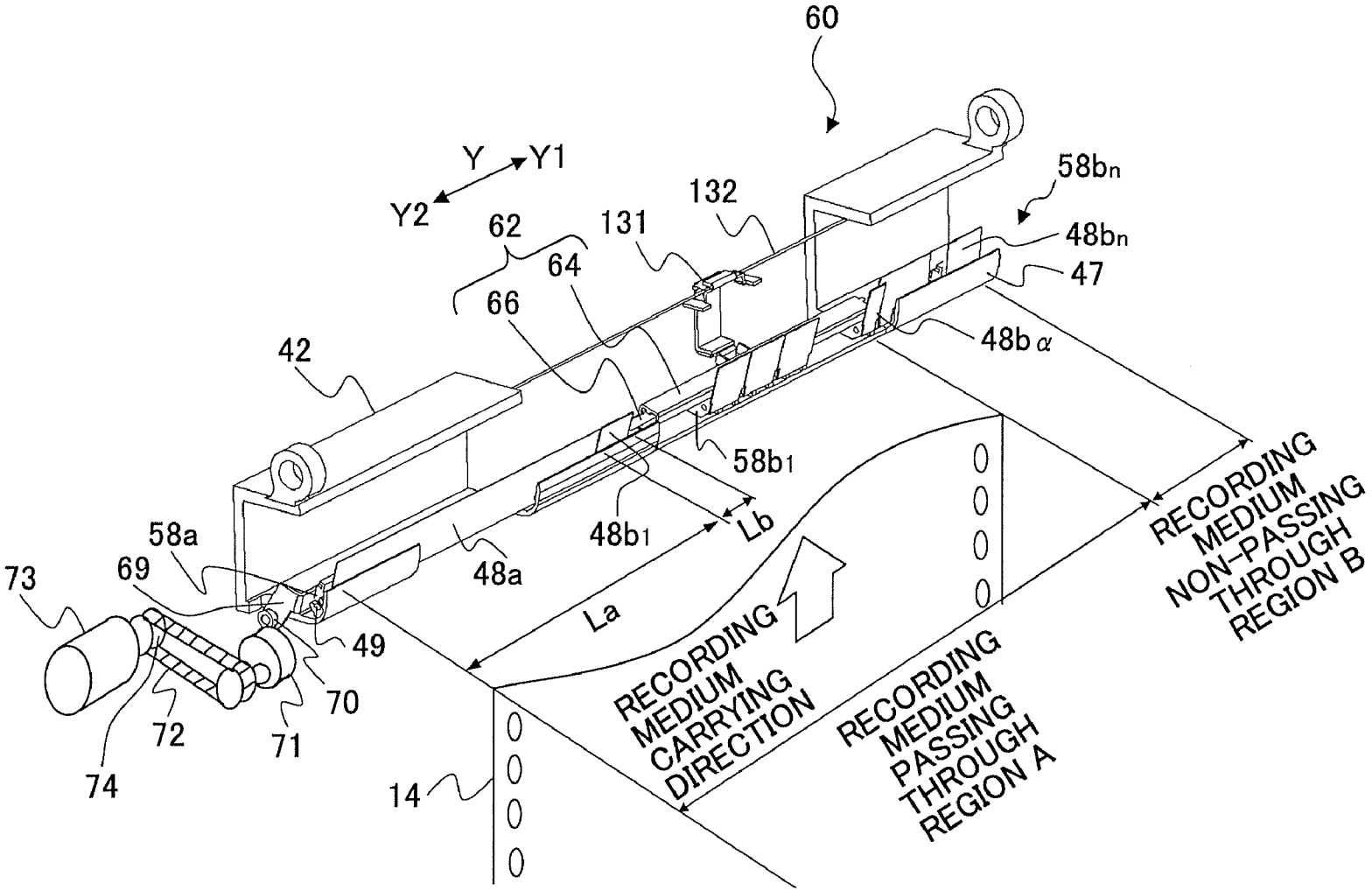
FIG. 5 is a perspective view of the transfer assist mechanism taken from the front of the transfer assist mechanism.
Figure 6:
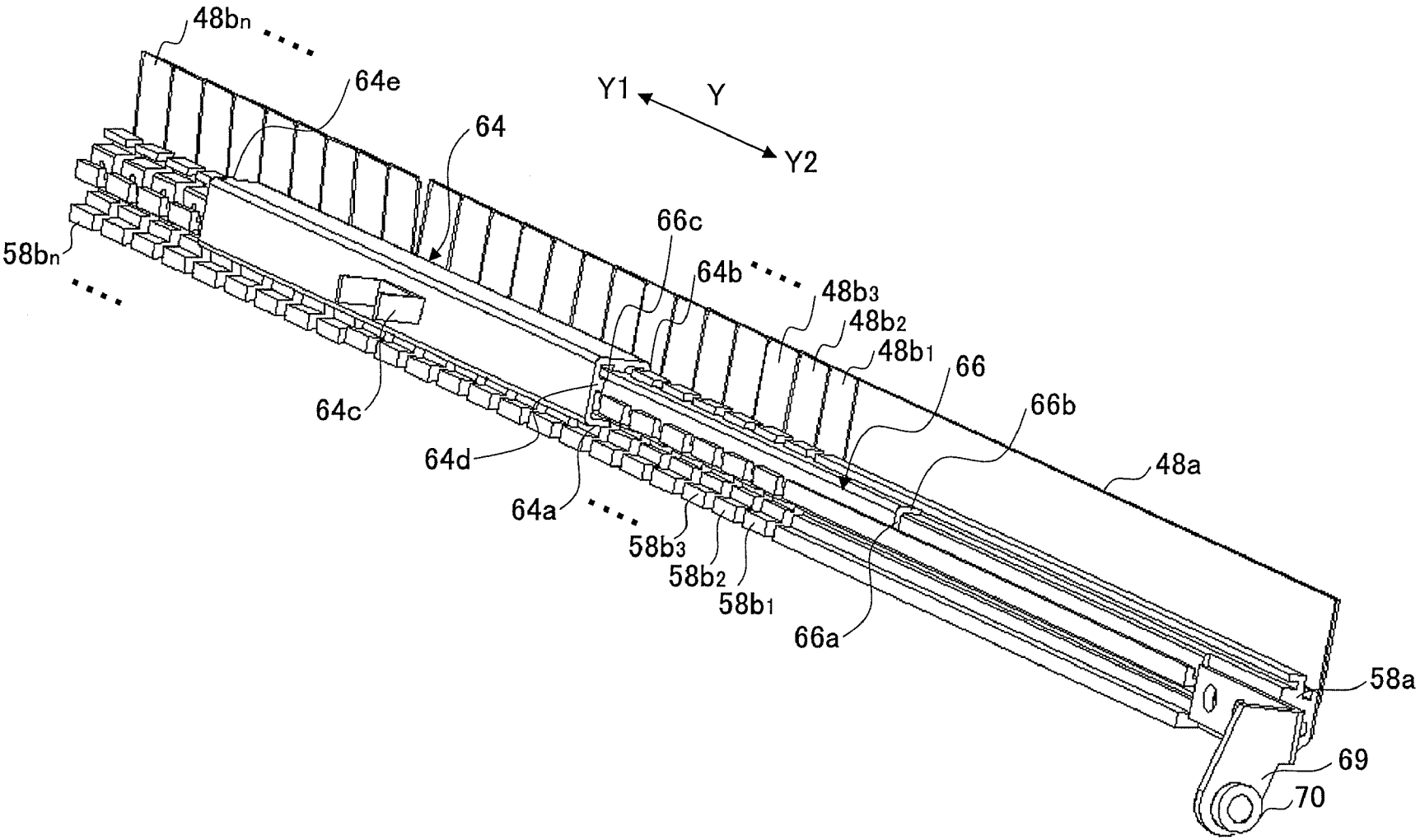
FIG. 6 is a perspective view of the transfer assist mechanism taken from the back of the transfer assist mechanism.

FIG. 5 is a perspective view of the transfer assist mechanism 60 taken from the front of the transfer assist mechanism 60. FIG. 6 is a perspective view of the transfer assist mechanism 60 taken from the back of the transfer assist mechanism 60. As shown in FIGS. 4 and 5, the first slide engaging member 64 and the second slide engaging member 66 of the slide engaging section 62 are disposed at the back of the blade holder 58.

As described above, the transfer assist blade 48 includes the first blade 48*a* and the plural second blades 48$b_1$ through 48$b_n$, and the blade holder 58 includes the first blade holder 58*a* which holds the first blade 48*a* and the second blade holders 48$b_1$ through 48$b_n$ which hold the corresponding second blades 48$b_1$ through 48$b_n$. In the Y direction (width direction of the continuous recording medium 14), a region where the first blade 48*a* and the plural second blades 48$b_1$ thought 48$b_\alpha$ ($\alpha \leqq n$) face the continuous recording medium 14 is a recording medium passing through region A, and a region where the second blades 48$b_\alpha$ through 48$b_n$ face a region where the continuous recording medium 14 does not exist is a recording medium non-passing through region B.

The first blade holder 58*a* and the second blade holders 58$b_1$ through 58$b_n$ are rotatably held by the hinge shaft 49 extended in the width direction of the continuous recording medium 14 (Y direction). Since the first blade holder 58*a* and the second blade holders 58$b_1$ through 58$b_n$ are rotated about the hinge shaft 49 as the center, the first blade 48*a* and second blade holders 48$b_1$ through 48$b_n$ are arrayed in a line in the Y direction.

In FIG. 5, the first blade holder 58*a* is formed so that the length "La" in the Y direction corresponds to the minimum printable width of the continuous recording medium 14. The second blade holders 58$b_1$ through 58$b_n$ are formed so that the length "Lb" in the Y direction corresponds to an incremental printable width of the corresponding continuous recording media 14. That is, depending on the width of the continuous recording medium 14, the length "Lb" is increased or decreased.

[Operations of Transfer Assist Blade and First and Second Slide Engaging Members]

The lengths of the first slide engaging member 64 and the second slide engaging member 66 in the Y direction are formed to be almost equal to the length of the first blade 48*a*. For example, when the width of the continuous recording medium 14 is the minimum width, the first slide engaging member 64 and the second slide engaging member 66 are at the left side position in FIG. 5 (the right side position in FIG. 6), and the second slide engaging member 66 is positioned between the first slide engaging member 64 and the first blade holder 58*a* and cannot be viewed from the outside. In this case, the first slide engaging member 64 and the second slide engaging member 66 are inserted only into the first blade holder 58*a* and are at a position apart from the second blade holders 58$b_1$ through 58$b_n$.

As shown in FIG. 6, the first slide engaging member 64 includes a driven section 64*c* at the back of the first slide engaging member 64 to which section a driving force (described below) is transmitted. When the first slide engaging member 64 is moved in the Y1 direction by the length "La", the back end 64*d* of the first slide engaging member 64 contacts (latches) the front end 66*c* of the second slide engaging member 66, and the first slide engaging member 64 pulls the second slide engaging member 66 in the Y1 direction. Therefore, the transfer assist mechanism 60 can respond to a wider continuous recording medium 14.

When the first slide engaging member 64 is moved in the Y2 direction by the length "La", the front end 64*e* of the first slide engaging member 64 contacts (latches) the front end 66*c* of the second slide engaging member 66, and the first slide engaging member 64 moves the second slide engaging member 66 in the Y2 direction. Therefore, the transfer assist mechanism 60 can respond to a narrower continuous recording medium 14.

That is, the press-able region of the blade holder 58 (58*a* and 58$b_1$ through 58$b_n$) is adjusted depending on the moved positions of the first slide engaging member 64 and the second slide engaging member 66. With this, the first blade holder 58*a* and some of the second bade holders 58$b_1$ through 58$b_n$ are selectively rotated corresponding to the width of the continuous recording medium 14.

In addition, the first blade holder 58*a* and the second blade holders 58$b_1$ through 58$b_n$ are rotatably held by the hinge shaft 49 attached to the lower separator 47, and a cam follower 70 fixed to the transfer housing 42 is attached to an arm 69 fixed at the end of the first blade holder 58*a*. A cam 71 is disposed at a position near the cam follower 70 and is connected to a driven pulley 74 which is driven by a motor 73 via a timing belt 72.

Therefore, the first blade 48*a* and some of the second blades 48$b_1$ through 48$b_n$ held by the corresponding first blade holder 58*a* and the corresponding second blade holders 58$b_1$ through 58$b_n$ are positioned to press the continuous recording medium 14, which passes through the nip region 68 (refer to FIG. 3) at the position of the first and second slide engaging members 64 and 66 due to the driving force of the motor 73, in the recording medium passing through region A corresponding to the width of the continuous recording medium 14. The others of the second transfer assist blades, for example, 48$b_\alpha$ through 48$b_n$ are positioned not to press the continuous recording medium 14.

For example, in the print mode, the driving force of the motor 73 rotates the first blade holder 58*a* and some of the second blade holders 58$b_1$ through 58$b_n$ clockwise at the position of the first and second slide engaging members 64 and 66 via the driven pulley 74, the timing belt 72, the cam 71, and the cam follower 70. With this, the tips of the first blade 48*a* and some of the second transfer assist blades 48$b_1$ through 48$b_n$ at the moved position of the first and second slide engaging members 64 and 66 contact the continuous recording medium 14 and the continuous recording medium 14 is pressed on the surface of the photosensitive drum 12 in the whole width of the continuous recording medium 14.

At the stop mode, the first blade holder 58*a* and some of the second blade holders 58$b_1$ through 58$b_n$ are rotated counterclockwise by the reverse rotation of the motor 73. With this, the tips of the first blade 48*a* and some of the second blades 48$b_1$ through 48$b_n$ are released from contacting the continuous recording medium 14 and the continuous recording medium 14 is released from pressing the surface of the photosensitive drum 12.

As shown in FIG. 3, the continuous recording medium 14 is guided by the upper separator 46 and the lower separator 47 and is passed through the nip region 68 where the continuous recording medium 14 contacts the surface of the photosensitive drum 12. At this time, the first blade 48*a* and some of the second blades 48$b_1$ through 48$b_n$ are moved to positions where the first blade 48*a* and some of the second blades 48$b_1$ through 48$b_n$ push the continuous recording medium 14 from the lower side of the nip region 68 by the rotation of the first blade holder 58*a* and some of the second blade holders 58$b_1$ through 58$b_n$. When the cam 71 is rotated by the motor 73, the first blade holder 58*a* and the second blade holders 58$b_1$ through 58$b_n$ are rotated and the first transfer assist blade 48*a* and the second transfer assist blades 48$b_1$ through 48$b_n$ are operated so that the entire width of the continuous recording medium 14 presses the surface of the photosensitive drum 12.

At the stop mode, the driving motor 55 (refer to FIG. 3) is rotated in reverse and the transfer housing 42 is rotated so that the photosensitive drum 12 is released from contacting the transfer housing 42. Even if the photosensitive drum 12 is rotated by inertia after being released from contacting the continuous recording medium 14, the movement of the continuous recording medium 14 is stopped by stopping the recording medium carrying members 22 through 25 (refer to FIG. 1).

As described above, in the embodiment of the present invention, since a region of the surface of the photosensitive drum 12 where the continuous recording medium 14 does not contact the surface of the photosensitive drum 12 is not pressed, the surface of the photosensitive drum 12 can be prevented from being damaged. In addition, since the positions of the first and second slide engaging members 64 and 66 are adjusted by the motor 73, some of the second blades 48$b_1$ through 48$b_n$ selectively push the continuous recording medium 14 corresponding to the width of the continuous recording medium 14. Therefore, the transfer assist mechanism 60 can be small and can be installed in a small space. With this, the cost of the transfer assist mechanism 60 can be low.

Figure 7:
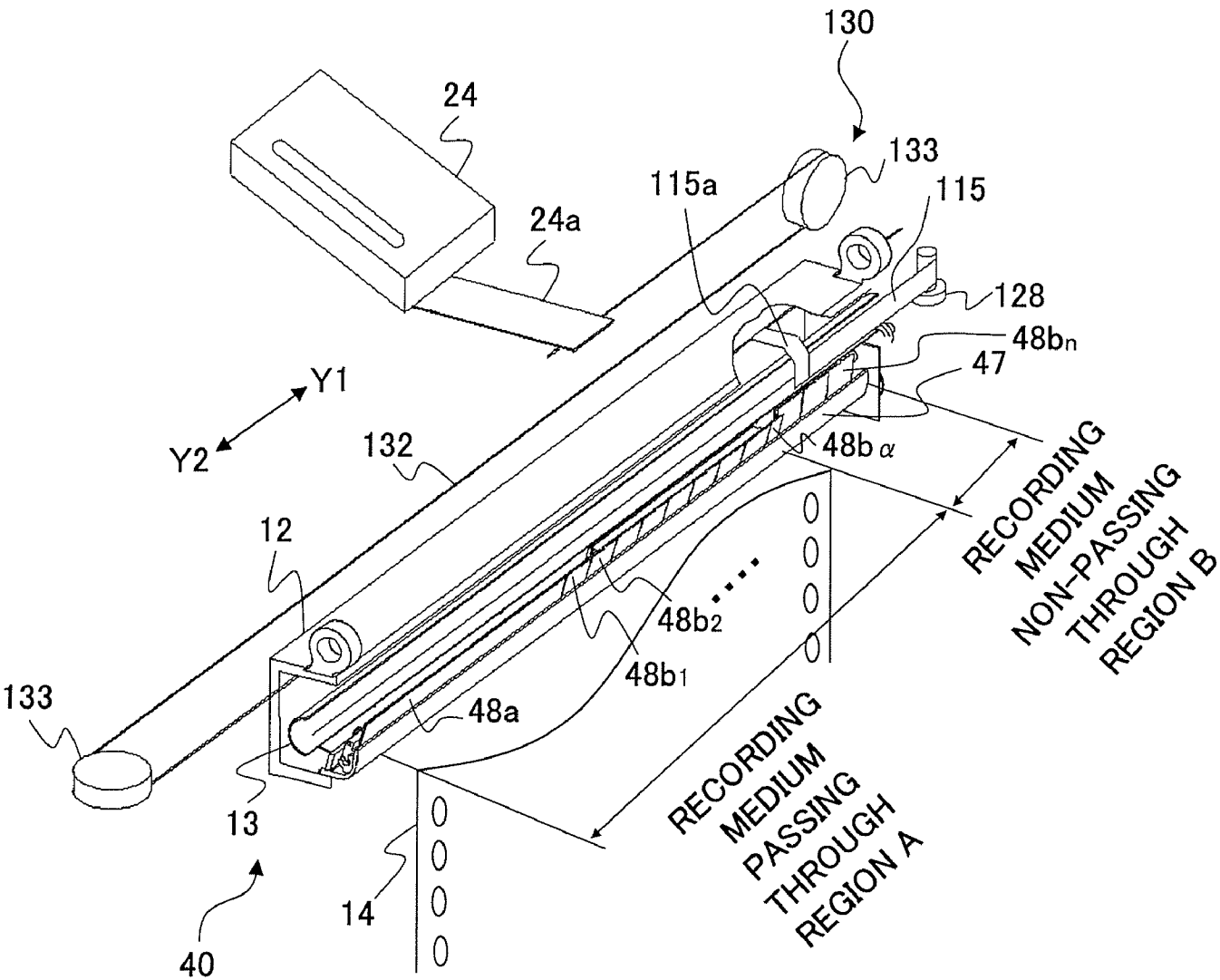
FIG. 7 is a perspective view of the transfer unit shown in FIG. 1.

FIG. 7 is a perspective view of the transfer unit 40. As shown in FIG. 7, the transfer unit 40 includes a pressing range adjusting mechanism 130. The pressing range adjusting mechanism 130 includes a wire 132 connected to a bracket 24*a* of the recording medium carrying member 24 and pulleys 133 around which the wire 132 is hung. The wire 132 is connected to an end 115*a* of a corotron mask 115. In addition, the wire 132 is connected to a wire clamper 131 (refer to FIG. 5) connected to the driven part 64*c* (refer to FIG. 6) of the first slide engaging member 64. With this, the operation of the first slide engaging member 64 can be performed together with the width direction adjusting operation of the recording medium carrying member 24.

When the width of the continuous recording medium 14 is changed, an operator adjusts the position of the recording medium carrying member 24 by using a recording medium width setting unit (not shown). When the recording medium carrying member 24 is moved, for example, in the Y1 direction, the wire damper 131 connected to the wire 132, which is connected to the bracket 24*a* of the recording medium carrying member 24, is moved in the Y1 direction. Since the wire damper 131 is connected to the driven part 64*c* of the first slide engaging member 64, when the wire 132 is moved, the first slide engaging member 64 is moved in the Y1 direction via the driven part 64*c*. Therefore, some of the second blades 48$b_1$ through 48$b_n$ are selected corresponding to the width of the continuous recording medium 14 and the first blade 48*a* and the selected second blades, for example, 48$b_1$ through 48$b_\alpha$ press the continuous recording medium 14 on the surface of the photosensitive drum 12.

The corotron mask 115 is disposed at the front surface of the corona transfer device 13 (refer to FIG. 1). The corotron mask 115 is wound around a reel 128 disposed outside the region where the continuous recording medium 14 is passed, and the end 115*a* of the corotron mask 115 is moved in the Y direction corresponding to the width of the continuous recording medium 14. The corotron mask 115 provides a shield between the corona transfer device 13 and the photosensitive drum 12 at the recording medium non-passing through region B and protects the photosensitive drum 14 from being damaged by corona discharge.

When a continuous recording medium 14 having a greater width is used, the end 115*a* of the corotron mask 115 is moved in the Y1 direction corresponding to the width of the continuous recording medium 14.

When a continuous recording medium 14 having a lesser width is used, the end 115*a* of the corotron mask 115 is moved in the Y2 direction corresponding to the width of the continuous recording medium 14. When the recording medium carrying member 24 is moved in the Y2 direction, the wire 132 connected to the recording medium carrying member 24 is moved. The wire 132 moves the wire damper 131 (refer to FIG. 5) in the Y2 direction via the pulleys 133.

By the movement of the wire 132, the first slide engaging member 64 is moved in the Y2 direction via the wire damper 131 and the driven part 64*c*. With this, the first blade 48*a* and some of the second blades 48$b_1$ through 48$b_n$ are selected corresponding to the width of the continuous recording medium 14 and the first blade 48*a* and selected some of the second blades, for example, 48$b_1$ through 48$b_\alpha$ push the continuous recording medium 14 to the surface of the photosensitive drum 12.

At the same time, the end 115*a* of the corotron mask 115 connected to the wire 132 is moved in the Y2 direction. When the cam 71 is rotated by the motor 73, the first blade 48*a* and the second blades 48$b_1$ through 48$b_\alpha$ are rotated and the continuous recording medium 14 is pressed on the surface of the photosensitive drum 12 in the whole width of the continuous recording medium 14.

As described above, according to the embodiment of the present invention, the number of the rotating transfer assist blades 48 (48*a*, 48$b_1$ through 48$b_n$) is changed corresponding to the movement of the first and second slide engaging member 64 and 66 in the Y direction based on the adjustment of the width of the continuous recording medium 14, and the transfer assist blade 48 is prevented from contacting the surface of the photosensitive drum 12 at the recording medium non-passing through region B.

As described above, in the print mode, the selected number of the transfer assist blades 48 in the transfer assist blades 48 (48*a* and 48$b_1$ through 48$b_n$) corresponding to the width of the continuous recording medium 14 press the surface of the photosensitive drum 12, and the unselected number of the transfer assist blades 48 at the recording medium non-passing through region B do not push the surface of the photosensitive drum 12. Consequently, the unselected number of the transfer assist blades 48 does not damage the surface of the photosensitive drum 12. Since the continuous recording medium 14 pushes the photosensitive drum 12 only in the adjusted width, a high-quality image can be printed.

As shown in FIG. 2, in a case of the tandem type printing system which can execute both sides printing on the continuous recording medium 14, the first and second image forming apparatuses 10A and 10B print images on the continuous recording medium 14. The continuous recording medium 14 is a roll sheet (paper) with or without perforations, and is carried at high speed in the range of 0.5 to 2 m per second. The continuous recording medium 14 does not have a cut line, and images are continuously printed on the continuous recording medium 14.

The first image forming apparatus 10A prints the first image 80 on the front surface 14*a* of the continuous recording medium 14 by using the first photosensitive drum 12A, the first developer 21A, the first transfer unit 40A, and so on. After printing the first image 80 on the front surface 14*a* of the continuous recording medium 14, the continuous recording medium 14 is reversed by the reversing mechanism 50. Then the second image forming apparatus 10B prints the second image 90 on the back surface 14*b* of the continuous recording medium 14 by using the second photosensitive drum 12B, the second developer 21B, the second transfer unit 40B, and so on.

[Fixing Section]

Figure 8:
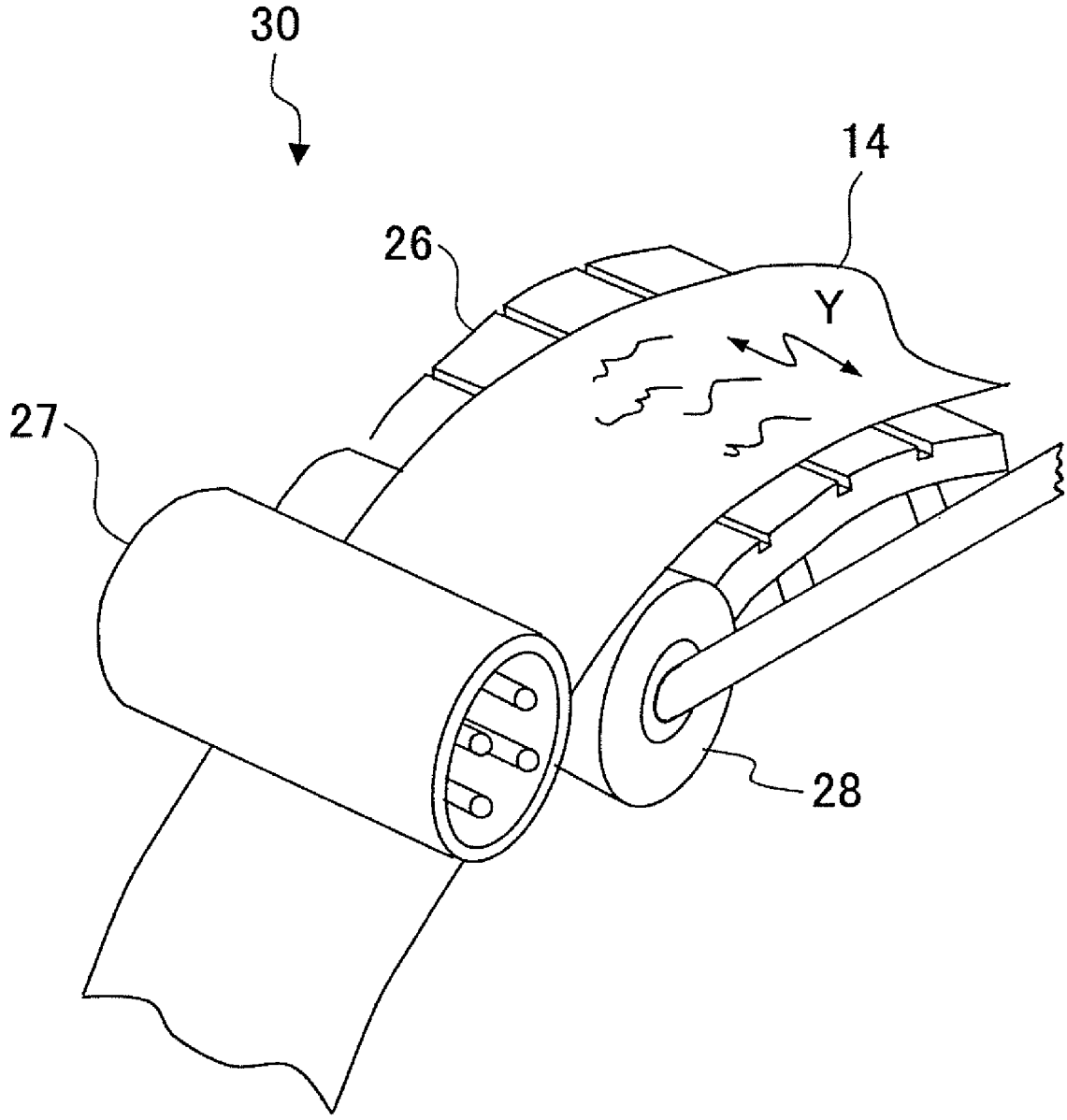
FIG. 8 is a perspective view of a fixing section shown in FIG. 1.

FIG. 8 is a perspective view of the fixing section 30. In FIG. 8, the movement of the continuous recording medium 14 is stopped. As described above, the fixing section 30 includes the pre-heater 26 which preheats the continuous recording medium 14 by contacting the continuous recording medium 14, the heat roller 27 having a heater, and the backup roller 28 which applies pressure to the heat roller 27.

The fixing section 30 continues to apply heat to the continuous recording medium 14 during the printing process. When the printing process is stopped, the movement of the continuous recording medium 14 is stopped. However, since the heat being applied to the continuous recording medium 14 does not immediately respond to stopping the continuous recording medium 14, the continuous recording medium 14 is over-heated. Consequently, the continuous recording medium 14 on the pre-heater 26 may be thermally expanded or shrunk in the Y direction and the surface of the continuous recording medium 14 may have a concave-convex surface caused by thermal damage. Therefore, after the first image forming apparatus 10A prints an image on the front surface 14*a* of the continuous recording medium 14, when another image is printed on the back surface 14*b* of the continuous recording medium 14 by the second image forming apparatus 10B, a low-quality image is likely to be formed on a part of the continuous recording medium 14 stopped on the pre-heater 26 of the first image forming apparatus 10A due to some thermal damage on the part of the continuous recording member 14 when the part is passed through the transfer unit 40 of the second image forming apparatus 10B.

However, according to the present embodiment, the transfer assist blade 48 (48*a*, 48*b*$_1$ through 48*b*$_n$) formed in the transfer unit 40 presses the continuous recording medium 14 on the surface of the photosensitive drum 12. With this, the concave-convex surface of the continuous recording medium 14 is corrected by being pressed on the surface of the photosensitive drum 12 when passing through the nip region 68 (refer to FIG. 3). Therefore, even if the continuous recording medium 14 has some deformation due to the fixing section 30 of the first image forming apparatus 10A, a high-quality image can be formed on the back surface 14*b* of the continuous recording medium 14 by the second image forming apparatus 10B.

Figure 9:
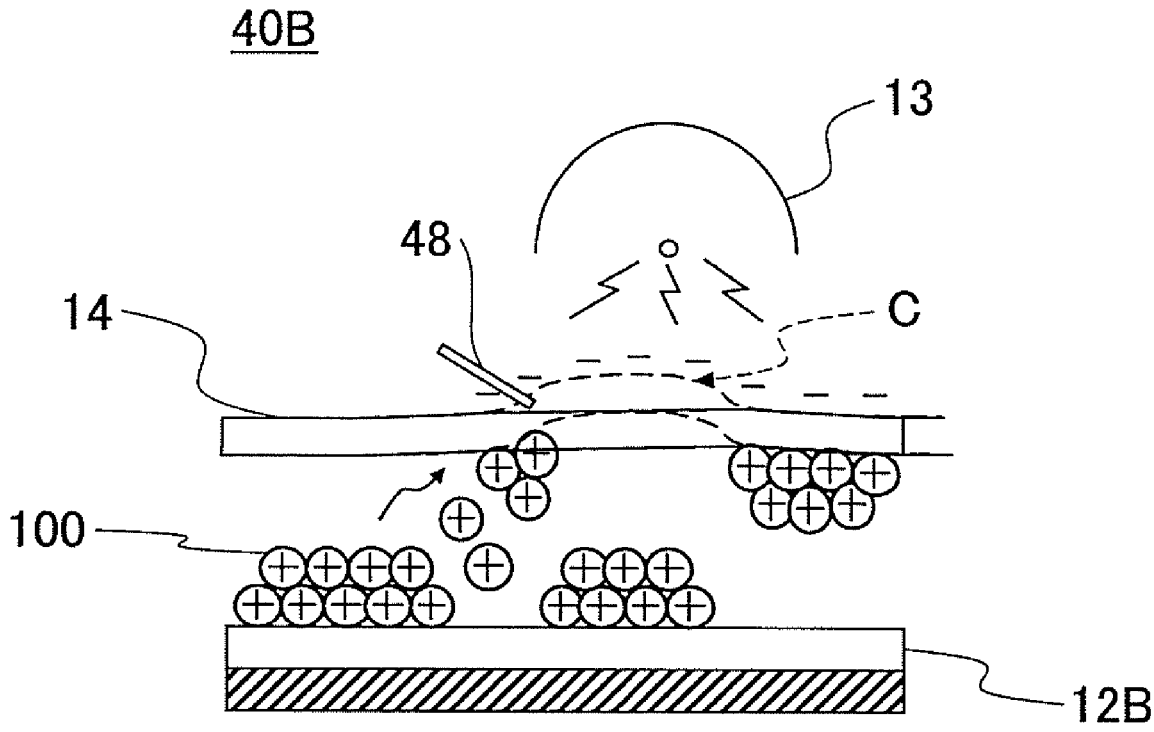
FIG. 9 is a schematic diagram showing a toner image transferring condition on a continuous recording medium at a transfer unit of a second image forming apparatus shown in FIG. 2.

FIG. 9 is a schematic diagram showing a toner image transferring condition on the continuous recording medium 14 at the transfer unit 40B of the second image forming apparatus 10B. As shown in FIG. 9, a toner image 100 having positive polarity is electrostatically adhered onto the surface of the photosensitive drum 12B. The continuous recording medium 14 is negatively charged by corona discharge of the corona transfer device 13, and the toner image 100 is transferred onto the continuous recording medium 14.

However, when a part of the continuous recording medium 14 is deformed into a concave shape viewed from the photosensitive drum 12B by heat as shown in "C" (dashed line) of FIG. 9, a part of the toner image 100 is not transferred onto the continuous recording medium 14. That is, a low-quality image is formed because a part of the toner image 100 is dropped.

However, as described above, according to the embodiment of the present invention, since the transfer assist blade 48 presses the continuous recording medium 14 on the surface of the photosensitive drum 12, the deformed surface of "C" of the continuous recording medium 14 can be flattened as shown in the continuous line of FIG. 9. Therefore, a high-quality image can be formed on the continuous recording medium 14 without dropping a part of the toner image 100.

As described above, according to the embodiment of the present invention, defective transfer of an image on the continuous recording medium 14 can be prevented during both sides printing. In addition, for both sides printing and one side printing, since a low-price recording medium (paper) such as recycled paper and rough surface paper can be used as the continuous recording medium 14 for forming a high quality image on the continuous recording medium 14, resource savings can be achieved in the image forming apparatus 10.

In the embodiment of the present invention, the continuous recording medium 14 is used in the image forming apparatus 10. However, the embodiment of the present invention can be applied to an image forming apparatus (printer) for a cut sheet recording medium.

In addition, according to the embodiment of the present invention, a case is described in which both sides printing is executed by using the first and second image forming apparatuses 10A and 10B. However, the embodiment of the present invention can be applied to an image forming apparatus having a both sides printing function in the image forming apparatus.

Further, the present invention is not limited to the specifically disclosed embodiment, and variations and modifications may be made without departing from the scope of the present invention.

The present invention is based on Japanese Priority Patent Application No. 2006-227892, filed on Aug. 24, 2006, with the Japanese Patent Office, the entire contents of which are hereby incorporated herein by reference.

What is claimed is:

1. An image forming apparatus, comprising:

a photosensitive body on which surface an electrostatic latent image is formed;

a developer which forms a toner image on the surface of the photosensitive body by developing the electrostatic latent image formed on the surface of the photosensitive body;

a transfer unit which transfers the toner image formed on the surface of the photosensitive body onto a recording medium;

recording medium carrying members which carry the recording medium to a nip region between the photosensitive body and the transfer unit;

a transfer assist mechanism which presses the recording medium on the surface of the photosensitive body by adjusting a width where the recording medium presses the surface of the photosensitive body corresponding to the width of the recording medium; wherein the transfer assist mechanism includes a hinge shaft which is disposed in a transfer housing of the transfer unit in parallel to the width direction of the recording medium;

a first blade holder having a first blade which is rotatably held by the hinge shaft by being formed in the width direction of the recording medium;

a plurality of second blade holders having corresponding second blades which are rotatably held by the hinge shaft by being formed with the first blade holder in the width direction of the recording medium;

first engaging grooves which are formed in the first blade holder and the plurality of second blade holders;

second engaging grooves which are formed in the first blade holder and the plurality of second blade holders;

a slide engaging member which is movably formed in the width direction of the recording medium by engaging the first engaging grooves and the second engaging grooves of the first blade holder and the first engaging grooves and the second engaging grooves of some of the second blade holders selected corresponding to the width of the recording medium;

a driving mechanism including a motor which drives the first blade holder and some of the second blade holders selected corresponding to the width of the recording medium in the pressing direction of the recording medium; and a pressing range adjusting mechanism for adjusting the number of the second blade holders with the second engaging grooves engaged by the slide engaging member by moving the slide engaging member in the width direction of the recording medium corresponding to the width of the recording medium.

2. The image forming apparatus as claimed in claim 1, wherein:

the size of each of the plural second blade holders is smaller than the size of the first blade holder in the width direction of the recording medium, and each of the plural second blade holders is formed to move independently of the first blade holder.

3. The image forming apparatus as claimed in claim 1, wherein:

the slide engaging member includes a first slide engaging member and a second slide engaging member, and when the first slide engaging member moves by a predetermined distance in the width direction of the recording medium, the first slide engaging member moves the second slide engaging member in the width direction of the recording medium by contacting the second slide engaging member.

4. The image forming apparatus as claimed in claim 3, wherein:

the pressing range adjusting mechanism includes a pair of pulleys which pulleys are disposed one at each end in the width direction of the recording medium;

a wire which is hung between the pulleys;

a wire damper which is connected to the wire and the first slide engaging member; and a bracket connected to one of the recording medium carrying members and the wire for adjusting the pressing range of the transfer assist mechanism corresponding to the width of the recording medium.

5. The image forming apparatus as claimed in claim 4, wherein:

the pressing range adjusting mechanism moves the second slide engaging member corresponding to the width of the recording medium which is set by the one of recording medium carrying members.

6. The image forming apparatus as claimed in claim 1, wherein:

the pressing range adjusting mechanism moves the slide engaging member corresponding to the width of the recording medium, and makes the slide engaging member engage the number of the second engaging grooves which number corresponds to the size in the width direction of the recording medium in the plural second blade holders.

* * * * *